US011327420B2

(12) United States Patent
Shimodaira

(10) Patent No.: US 11,327,420 B2
(45) Date of Patent: May 10, 2022

(54) IMAGE FORMING APPARATUS

(71) Applicant: FUJIFILM Business Innovation Corp., Tokyo (JP)

(72) Inventor: Akira Shimodaira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/934,604

(22) Filed: Jul. 21, 2020

(65) Prior Publication Data

US 2021/0271189 A1 Sep. 2, 2021

(30) Foreign Application Priority Data

Mar. 2, 2020 (JP) ..... JP2020-034893

(51) Int. Cl.

| | |
|---|---|
| ***G03G 15/16*** | (2006.01) |
| ***G03G 15/00*** | (2006.01) |
| ***G03G 9/09*** | (2006.01) |
| ***G03G 9/08*** | (2006.01) |

(52) U.S. Cl.

CPC ..... *G03G 15/1675* (2013.01); *G03G 9/0819* (2013.01); *G03G 9/0821* (2013.01); *G03G 9/09* (2013.01); *G03G 15/1605* (2013.01); *G03G 15/602* (2013.01); *G03G 2215/00654* (2013.01); *G03G 2215/00679* (2013.01); *G03G 2215/00708* (2013.01); *G03G 2215/1666* (2013.01); *G03G 2221/0073* (2013.01)

(58) Field of Classification Search

CPC ..... G03G 15/1675; G03G 9/0819; G03G 15/1605; G03G 9/09; G03G 15/602; G03G 9/0821; G03G 2215/1666; G03G 2221/0073; G03G 2215/00679; G03G 2215/00708; G03G 2215/00654

See application file for complete search history.

(56) References Cited

U.S. PATENT DOCUMENTS

| | | | | |
|---|---|---|---|---|
| 7,463,835 | B2 | 12/2008 | Harumoto | |
| 7,937,014 | B2 | 5/2011 | Kawamata | |
| 8,918,039 | B2 | 12/2014 | Arikawa et al. | |
| 2005/0031384 | A1* | 2/2005 | Sohmiya | G03G 15/167 399/309 |
| 2006/0188299 | A1* | 8/2006 | Matsumoto | G03G 15/0142 399/302 |

FOREIGN PATENT DOCUMENTS

| | | | | |
|---|---|---|---|---|
| EP | 0756213 | A1 * | 1/1997 | G03G 15/0194 |
| EP | 0886186 | A1 * | 12/1998 | G03G 9/0819 |
| JP | H11190926 | A * | 7/1999 | |
| JP | 2000298413 | A * | 10/2000 | G03G 15/2021 |
| JP | 2007-304192 | A | 11/2007 | |

(Continued)

*Primary Examiner* — Ryan D Walsh

(74) *Attorney, Agent, or Firm* — Sughrue Mion, PLLC

(57) ABSTRACT

An image forming apparatus includes a transfer unit configured to transfer second charged images superposed with one another onto a holding surface of a recording medium on which at least one first charged image has been electrostatically held and a static eliminating unit disposed upstream from the transfer unit in a transport direction of the recording medium and configured to remove static electricity from the recording medium electrostatically holding the at least one first charged image.

20 Claims, 11 Drawing Sheets

(56) References Cited

FOREIGN PATENT DOCUMENTS

| | | | | | |
|---|---|---|---|---|---|
| JP | 2007-310226 | A | | 11/2007 | |
| JP | 2009-086517 | A | | 4/2009 | |
| JP | 2014-059391 | A | | 4/2014 | |
| JP | 5967060 | B2 | * | 8/2016 | ..... G03G 15/1695 |
| JP | 2020003680 | A | * | 1/2020 | ..... G03G 15/1675 |

* cited by examiner

IMAGE FORMING APPARATUS

CROSS-REFERENCE TO RELATED APPLICATIONS

This application is based on and claims priority under 35 USC 119 from Japanese Patent Application No. 2020-034893 filed Mar. 2, 2020.

BACKGROUND

(i) Technical Field

The present disclosure relates to an image forming apparatus.

(ii) Related Art

Japanese Unexamined Patent Application Publication No. 2009-86517 discloses an image forming apparatus including a transport belt that transports a sheet in the vertical direction and an attracting roller that causes the sheet to be attracted to the transport belt.

When a first charged image, such as a toner image, is held on a recording medium by being, for example, transferred thereto, the recording medium is charged, and if a second charged image is transferred onto the recording medium while the recording medium maintains its charged state, irregularities may sometimes occur in the charged images.

SUMMARY

Aspects of non-limiting embodiments of the present disclosure relate to suppressing occurrence of irregularities in charged images compared with a configuration in which a charged state of a recording medium that is brought when a first charged image is held on the recording medium is continuously maintained until a second charged image is transferred onto the recording medium.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a transfer unit configured to transfer a plurality of second charged images superposed with one another onto a holding surface of a recording medium on which at least one first charged image has been electrostatically held and a static eliminating unit disposed upstream from the transfer unit in a transport direction of the recording medium and configured to remove static electricity from the recording medium electrostatically holding the at least one first charged image.

BRIEF DESCRIPTION OF THE DRAWINGS

Exemplary embodiments of the present disclosure will be described in detail based on the following figures, wherein.

DETAILED DESCRIPTION

Figure 1:
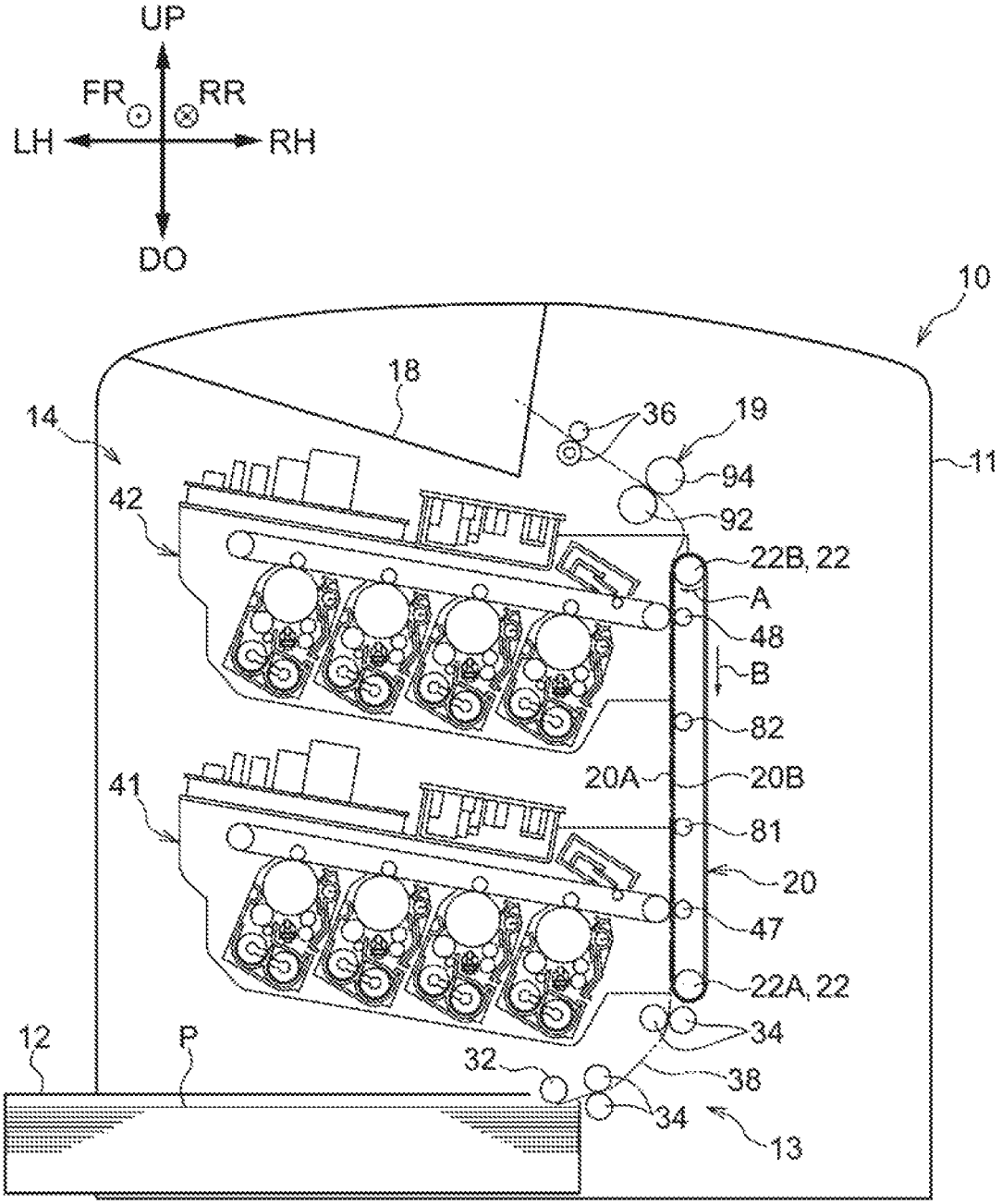
FIG. 1 is a schematic diagram illustrating a configuration of an image forming apparatus according to the present exemplary embodiment.

An exemplary embodiment of the present disclosure will be described below with reference to the drawings.

Note that arrow UP and arrow DO in the drawings respectively indicate a direction toward the upper side of an apparatus (an upward vertical direction) and a direction toward the lower side of the apparatus (a downward vertical direction). Arrow LH and arrow RH in the drawings respectively indicate a direction toward the left-hand side of the apparatus and a direction toward the right-hand side of the apparatus. Arrow FR and arrow RR in the drawings respectively indicate a direction toward the front side of the apparatus and a direction toward the rear side of the apparatus. These directions are defined for convenience of description, and thus, the configuration of the apparatus is not limited to these directions.

The directions toward the upper and lower sides of the apparatus may sometimes be referred to as the vertical direction of the apparatus. The vertical direction of the apparatus is also the direction of gravity. The directions toward the left-hand and right-hand sides of the apparatus may sometimes be referred to as the transverse direction of the apparatus. The transverse direction of the apparatus is also a width direction of the apparatus (the horizontal direction). The directions toward the front and rear sides of the apparatus may sometimes be referred to as the longitudinal direction of the apparatus. The longitudinal direction of the apparatus is also a depth direction of the apparatus (the horizontal direction). These directions of the apparatus may sometimes be mentioned by omitting the term "apparatus". In other words, for example, the direction toward the upper side of the apparatus may sometimes be simply referred to as "the upward direction" or "the upper side".

An arrow extending from the front side to the rear side in the drawings is denoted by an encircled cross, and an arrow extending from the rear side to the front side in the drawings is denoted by an encircled dot.

<Image Forming Apparatus 10>

The configuration of an image forming apparatus 10 according to the present exemplary embodiment will be described. FIG. 1 is a schematic diagram illustrating the configuration of the image forming apparatus 10 according to the present exemplary embodiment.

The image forming apparatus 10 illustrated in FIG. 1 is an example of an image forming apparatus that forms an image onto a recording medium. Specifically, the image forming apparatus 10 is an image forming apparatus that employs an electrophotographic system and forms toner images (examples of images) onto recording media P. More specifically, as illustrated in FIG. 1, the image forming apparatus 10 includes an apparatus body 11, an accommodating unit 12, an ejection unit 18, a transport unit 13, an image forming section 14, a fixing device 19, and static eliminating rollers 81 and 82. The units (the apparatus body 11, the accommodating unit 12, the ejection unit 18, the transport unit 13, the image forming section 14, the fixing device 19, and the static eliminating rollers 81 and 82) included in the image forming apparatus 10 will be described below.

(Apparatus Body 11, Accommodating Unit 12, and Ejection Unit 18)

The apparatus body 11 illustrated in FIG. 1 has a function of accommodating each component. The apparatus body 11 is formed of, for example, a housing that is formed to have the shape of a box.

The accommodating unit 12 has a function of accommodating the recording media P. As illustrated in FIG. 1, the accommodating unit 12 is disposed on the lower side in the apparatus body 11. In the present exemplary embodiment, the recording media P are accommodated in the accommodating unit 12 by being stacked on top of one another in the accommodating unit 12. Note that, in addition to normal sheets, media such as films, coated paper, and OHP paper that are made of a resin or that contain a resin are used as the recording media P.

The recording media P on which toner images have been formed are ejected to the ejection unit 18. As illustrated in FIG. 1, the ejection unit 18 is provided on the upper side of the apparatus body 11. In the present exemplary embodiment, the recording media P that are ejected toward the ejection unit 18 are stacked on top of one another in the ejection unit 18.

(Transport Unit 13)

The transport unit 13 illustrated in FIG. 1 has a function of transporting the recording media P. Specifically, the transport unit 13 has a function of transporting the recording media P along a transport path 38 that extends in the vertical direction. More specifically, the transport unit 13 has a function of transporting the recording media P upward along the transport path 38 from the accommodating unit 12 to the ejection unit 18.

To describe it more specifically, as illustrated in FIG. 1, the transport unit 13 includes a delivery roller 32, a plurality of transport rollers 34, a transport belt 20, and ejection rollers 36. The delivery roller 32 is a roller that sends out the recording media P accommodated in the accommodating unit 12. The plurality of transport rollers 34 are rollers that transport the recording media P sent by the delivery roller 32 toward the transport belt 20.

The transport belt 20 is disposed along the transport path 38, which extends in the vertical direction. The transport belt 20 has a function of transporting each of the recording media P by coming into contact with a surface of the recording medium P.

Specifically, the transport belt 20 has a belt-like shape having a width in the longitudinal direction and is formed in a ring-like shape. More specifically, for example, the transport belt 20 is formed in an endless loop shape.

To be more specific, the transport belt 20 is wound around a pair of rollers 22. Specifically, the pair of rollers 22 are arranged vertically (in the vertical direction) with a gap formed therebetween, and the transport belt 20 is wound around the pair of rollers 22 such that tension is exerted on the transport belt 20. More specifically, as the pair of rollers 22, a driven roller 22A that is disposed on the lower side in the apparatus body 11 and a driving roller 22B that is disposed above the driven roller 22A are used, and the transport belt 20 is wound around the pair of rollers 22 such that tension is exerted on the transport belt 20. In the present exemplary embodiment, the driving roller 22B is caused to rotate in one direction (the direction of arrow A) by a driving source (not illustrated), so that the transport belt 20 moves circularly in one direction (the direction of arrow B).

To be more specific, the transport belt 20 has a function of transporting each of the recording media P as a result of its outer circumferential surface coming into contact with a non-image surface of the recording medium P. Specifically, the transport belt 20 transports each of the recording media P as a result of a contact surface 20A thereof coming into contact with the non-image surface of the recording medium P, the contact surface 20A being a portion of the outer circumferential surface of the transport belt 20 that faces the left-hand side (the side on which a first intermediate transfer belt 71 and a second intermediate transfer belt 72, which will be described later, are arranged). More specifically, the transport belt 20 transports each of the recording media P by electrostatically attracts the non-image surface of the recording medium P onto the contact surface 20A. Note that the contact surface 20A is specifically a surface extending linearly in the vertical direction. In addition, the non-image surface of each of the recording media P is a surface that is opposite to an image surface (an example of a holding surface) of the recording medium P on which toner images are formed. As described above, in the present exemplary embodiment, the transport belt 20 transports the recording media P from the lower side toward the upper side in the direction of gravity.

The ejection rollers 36 are rollers that eject, to the ejection unit 18, the recording media P each of which has passed through the fixing device 19 after being transported by the transport belt 20.

As described above, in the transport unit 13, the recording media P are transported upward. Thus, in the transport unit 13, the upward direction is the transport direction of the recording media P. In addition, in the transport unit 13, the lower side is the upstream side in the transport direction, and the upper side is the downstream side in the transport direction.

(Image Forming Section 14)

The image forming section 14 illustrated in FIG. 1 has a function of forming toner images (examples of images) onto the recording media P. More specifically, as illustrated in FIG. 1, the image forming section 14 includes a first image forming section 41, a second image forming section 42, and two second transfer rollers 47 and 48.

The configurations of the first image forming section 41, the second image forming section 42, and the two second transfer rollers 47 and 48 will be described below.

[First Image Forming Section 41]

As illustrated in FIG. 1, the first image forming section 41 is disposed on the lower side in the apparatus body 11. More specifically, the first image forming section 41 is disposed above the accommodating unit 12 and on the left-hand side of the transport belt 20.

Figure 2:
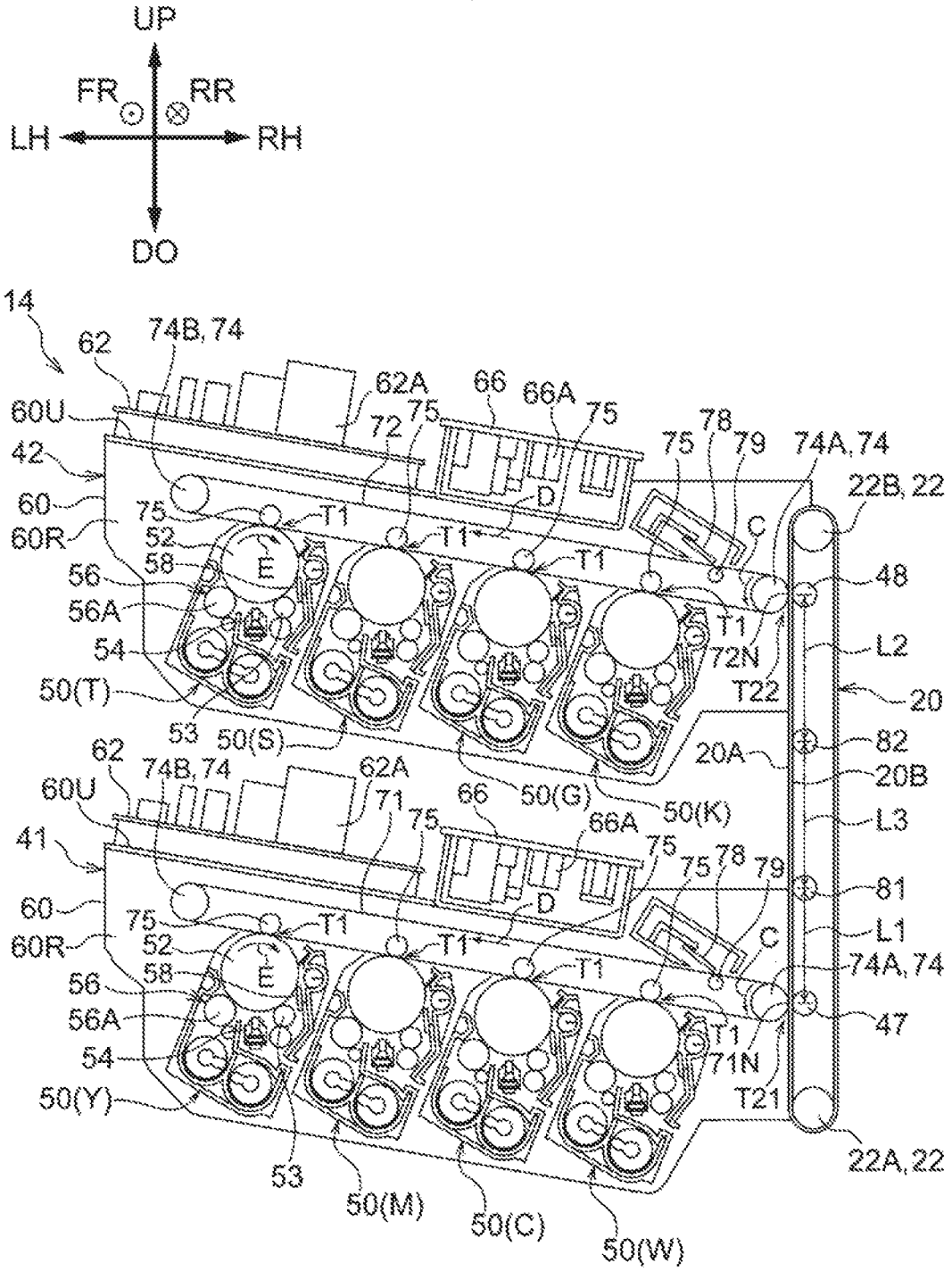
FIG. 2 is a schematic diagram illustrating configurations of a transport belt, a first image forming unit, and a second image forming unit according to the present exemplary embodiment.

As illustrated in FIG. 2, the first image forming section 41 includes a section body 60, four toner image forming units 50, four first transfer rollers 75, and the first intermediate transfer belt 71. In addition, as illustrated in FIG. 3, the first image forming section 41 includes a motor 68, a power supply board 62, a control board 64, and a high-voltage power supply board 66.

More specifically, as illustrated in FIG. 2, the first image forming section 41 includes toner image forming units 50 each of which corresponds to one of four colors of yellow (Y), magenta (M), cyan (C), and white (W) as the above-mentioned four toner image forming units 50. The reference characters (Y), (M), (C), and (W) illustrated in FIG. 2 indicate components that correspond to the above-mentioned colors. The toner image forming units 50 for the different colors are configured in a similar manner except with regard to the differences between toners to be used thereby. Thus, in FIG. 2, as representatives of the components of the toner image forming units 50 for the different colors, reference signs are given to the components of the toner image forming unit 50(Y). The units (the section body 60, the four toner image forming units 50, the four first transfer rollers 75, the first intermediate transfer belt 71, the motor 68, the power supply board 62, the control board 64, and the high-voltage power supply board 66) included in the first image forming section 41 will be described below.

[Section Body 60]

Figure 3:
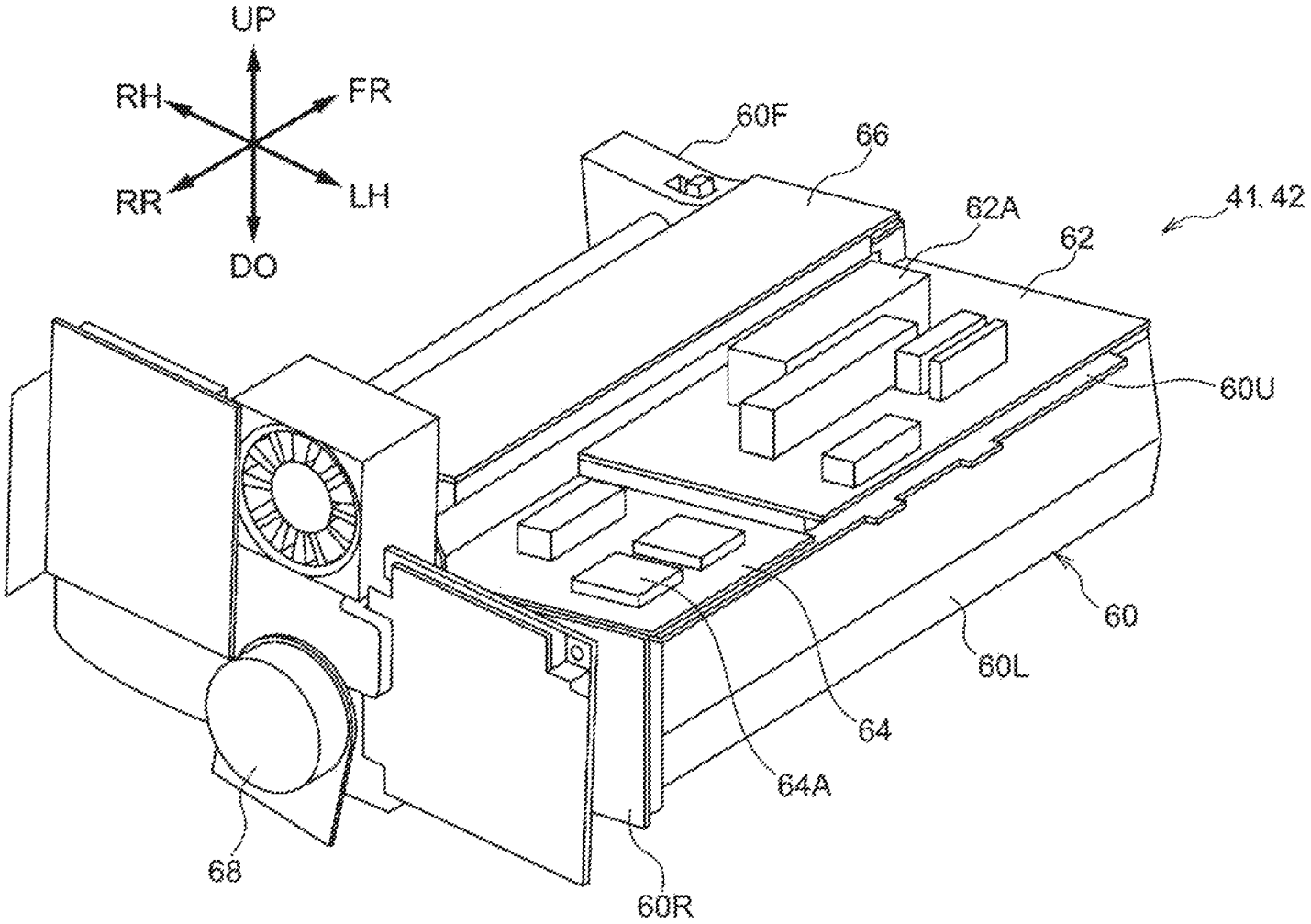
FIG. 3 is a perspective view illustrating the configuration of the first image forming unit (the second image forming unit) according to the present exemplary embodiment.

The section body 60 illustrated in FIG. 3 functions as a support that supports each unit included in the first image forming section 41. For example, the section body 60 is formed of a frame that is formed of a sheet metal. As illustrated in FIG. 3, the section body 60 has, for example, an upper wall 60U, a front wall 60F, a rear wall 60R, and a left wall (side wall) 60L. Note that the front wall 60F and the left wall (side wall) 60L are not illustrated in FIG. 2.

[Toner Image Forming Units 50]

The toner image forming units 50 for the different colors each have a function of forming a toner image. More specifically, as illustrated in FIG. 2, the toner image forming units 50 for the different colors each include a photoconductor drum (a photoconductor) 52 that rotates in one direction (the direction of arrow E). In addition, the toner image forming units 50 for the different colors each include a charging device 53, an exposure device 54, a developing device 56, and a removal device 58.

In each of the toner image forming units 50 for the different colors, the charging device 53 charges the photoconductor drum 52. In addition, the exposure device 54 exposes the photoconductor drum 52, which has been charged by the charging device 53, to light and forms an electrostatic latent image on the photoconductor drum 52. The developing device 56 develops an electrostatic latent image, which has been formed on the photoconductor drum 52 by the exposure device 54, into a toner image. The removal device 58 is formed of a blade that removes toner that remains on the photoconductor drum 52 after a toner image has been transferred to the first intermediate transfer belt 71.

[First Transfer Rollers 75]

As illustrated in FIG. 2, the four first transfer rollers 75 are arranged in a space enclosed by the first intermediate transfer belt 71 (on the inner periphery side of the first intermediate transfer belt 71). More specifically, each of the four first transfer rollers 75 is disposed in such a manner as to face a corresponding one of the photoconductor drums 52 for the different colors with the first intermediate transfer belt 71 interposed therebetween.

Each of the first transfer rollers 75 has a function of transferring a toner image formed on a corresponding one of the photoconductor drums 52 for the different colors onto the first intermediate transfer belt 71 at a first transfer position T1 between the first transfer roller 75 and the photoconductor drum 52. In the present exemplary embodiment, as a result of a first transfer voltage being applied between the first transfer rollers 75 and the photoconductor drums 52, toner images formed on the photoconductor drums 52 are transferred onto the first intermediate transfer belt 71 at the first transfer positions T1. As a result, the toner images formed on the photoconductor drums 52 for the different colors are transferred in a first transfer process onto the first intermediate transfer belt 71 in such a manner as to be superposed with one another.

[First Intermediate Transfer Belt 71]

The first intermediate transfer belt 71 has a function of transporting toner images that have been transferred thereto from the photoconductor drums 52 for the different colors of the first image forming section 41 to a first second transfer position T21, which will be described later. More specifically, the first intermediate transfer belt 71 has the following configuration.

The first intermediate transfer belt 71 has a belt-like shape whose widthwise direction is the same as the longitudinal direction and is formed in a ring-like shape. More specifically, for example, the first intermediate transfer belt 71 is formed in an endless loop shape.

To be more specific, the first intermediate transfer belt 71 is wound around a pair of rollers 74. Specifically, the pair of rollers 74 are arranged laterally with a gap formed therebetween, and the first intermediate transfer belt 71 is wound around the pair of rollers 74 such that tension is exerted on the first intermediate transfer belt 71. More specifically, a driving roller 74A that is disposed on the right-hand side (the side on which the transport belt 20 is disposed) in the apparatus body 11 and a driven roller 74B that is disposed on the left-hand side of the driving roller 74A (the side opposite to the side on which the driving roller 74A is disposed with respect to the transport belt 20) are used as the pair of rollers 74, and the first intermediate transfer belt 71 is wound around the pair of rollers 74 such that tension is exerted on the first intermediate transfer belt 71. In the present exemplary embodiment, the driving roller 74A is caused to rotate in one direction (the direction of arrow C) by the motor 68 (see FIG. 3), so that the first intermediate transfer belt 71 moves circularly in one direction (the direction of arrow D). Note that the driving roller 74A functions as a roller (a backup roller) that faces the second transfer roller 47.

A portion of the first intermediate transfer belt 71 that is wound around the driving roller 74A defines a contact region (a nip region) 71N by being in contact with the transport belt 20. The contact region 71N corresponds to the first second transfer position T21 at which toner images on the first intermediate transfer belt 71 are transferred onto one of the recording media P. The first intermediate transfer belt 71 transports each of the recording media P by nipping the recording medium P between the first intermediate transfer belt 71 and the transport belt 20 in the contact region 71N.

Note that the first image forming section 41 includes a removal unit 78 that removes toner remaining on the first intermediate transfer belt 71 after toner images have been transferred to one of the recording media P. The removal unit 78 is formed of a blade that is disposed on the upper side of the first intermediate transfer belt 71 and between the high-voltage power supply board 66 and the transport belt 20. A counter roller 79 that faces the removal unit 78 with the first intermediate transfer belt 71 interposed therebetween is disposed below the removal unit 78.

[Motor 68]

As illustrated in FIG. 3, the motor 68 is disposed on the rear wall 60R of the section body 60 of the first image forming section 41. The motor 68 functions as a driving source that drives a driving portion of the first image forming section 41. More specifically, for example, the motor 68 drives the photoconductor drums 52, developing rollers 56A of the developing devices 56, the driving roller 74A around which the first intermediate transfer belt 71 is wound, and so forth via a gear train (not illustrated). In addition, for example, a driving force of the motor 68 is transmitted to the delivery roller 32, the plurality of transport rollers 34, and so forth that are included in the transport unit 13, and the delivery roller 32 and the plurality of transport rollers 34 are driven so as to rotate.

[Power Supply Board 62, Control Board 64, and High-Voltage Power Supply Board 66]

As illustrated in FIG. 2 and FIG. 3, the power supply board 62, the control board 64, and the high-voltage power supply board 66 are arranged on the upper portion of the section body 60.

The power supply board 62 is supplied with electrical power from a power supply (not illustrated) that is disposed outside the image forming apparatus 10 through an electric wire (not illustrated) and has a function of supplying electrical power having a predetermined voltage to the motor 68 and so forth. The power supply board 62 is provided with an electronic component 62A disposed on its upper surface.

The control board 64 has a function of controlling driving of each unit included in the first image forming section 41. The control board 64 includes a recording unit formed of, for example, read only memory (ROM) in which programs are recorded or a storage and a processor that operates in accordance with the programs. The control board 64 is provided with an electronic component 64A disposed on its upper surface.

Figure 4:
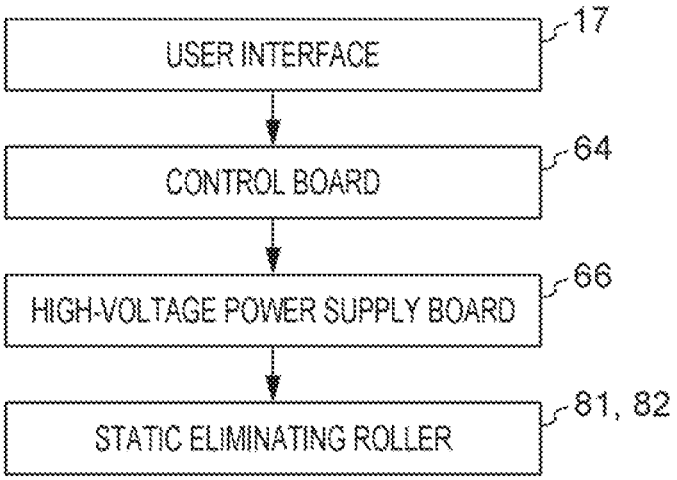
FIG. 4 is a schematic diagram illustrating a control system that controls an operation of a static eliminating roller according to the present exemplary embodiment.

As illustrated in FIG. 4, a user interface 17 (hereinafter referred to as "UI 17") that serves as an operation unit is connected to the control board 64. The UI 17 is formed of, for example, a liquid crystal display unit with a touch panel. An operation button (virtual button) and information to be provided to an operator (user) are displayed on a screen of the UI 17.

An operator operates the operation button through the UI 17, so that image formation conditions including selection of the type of the recording media P are specified. Note that any operation unit that enables an operation for specifying such image formation conditions may be used as the operation unit, and for example, a personal computer (PC) that is connected to the image forming apparatus 10 via a network may be used.

The high-voltage power supply board 66 is supplied with electrical power from a power supply (not illustrated) that is disposed outside the image forming apparatus 10 through an electric wire (not illustrated) and has a function of supplying electrical power having a voltage higher than the voltage of the power supply board 62 to the charging device 53, the developing device 56, the four first transfer rollers 75, the second transfer rollers 47 and 48, the static eliminating rollers 81 and 82, and so forth. The high-voltage power supply board 66 is provided with an electronic component 66A (see FIG. 2) disposed on its lower surface. Note that the high-voltage power supply board 66 may be supplied with electrical power from the power supply board 62.

[Second Image Forming Section 42]

As illustrated in FIG. 1, the second image forming section 42 is disposed on the upper side in the apparatus body 11. More specifically, the second image forming section 42 is disposed above the first image forming section 41 and on the left-hand side of the transport belt 20. In addition, the second image forming section 42 is disposed in such a manner as to overlap the first image forming section 41 in the vertical direction.

In the present exemplary embodiment, the second image forming section 42 is configured in a similar manner to the first image forming section 41. More specifically, as illustrated in FIG. 2, the second image forming section 42 includes the section body 60, the four toner image forming units 50, the four first transfer rollers 75, and the second intermediate transfer belt 72. As illustrated in FIG. 3, the second image forming section 42 further includes the motor 68, the power supply board 62, the control board 64, and the high-voltage power supply board 66.

As illustrated in FIG. 2, the second image forming section 42 includes toner image forming units 50 each of which corresponds to one of four colors of transparent (T), silver (S), gold (G), and black (K) as the above-mentioned four toner image forming units 50. The reference characters (T), (S), (G), and (K) illustrated in FIG. 2 indicate components that correspond to the above-mentioned colors. The toner image forming units 50 for the different colors are configured in a similar manner except with regard to the differences between toners to be used thereby. Thus, in FIG. 2, as representatives of the components of the toner image forming units 50 for the different colors, reference signs are given to the components of the toner image forming unit 50(T). In addition, the toner image forming units 50 of the second image forming section 42 are configured in a similar manner the toner image forming units 50 of the first image forming section 41 except with regard to the differences between toners to be used thereby, and thus, descriptions thereof will be omitted.

The section body 60, the four first transfer rollers 75, the power supply board 62, the control board 64, and the high-voltage power supply board 66 in the second image forming section 42 are configured in a similar manner to the section body 60, the four first transfer rollers 75, the power supply board 62, the control board 64, and the high-voltage power supply board 66 in the first image forming section 41, respectively, and thus, descriptions thereof will be omitted.

For example, the motor 68 in the second image forming section 42 drives the photoconductor drums 52, the developing rollers 56A of the developing devices 56, the driving roller 74A around which the second intermediate transfer belt 72 is wound, and so forth via a gear train (not illustrated). In addition, for example, the driving force of the motor 68 is transmitted to the driving roller 22B for the transport belt 20, a heating roller 92 (described later) of the fixing device 19, and so forth, and the driving roller 22B and the heating roller 92 are driven so as to rotate. Note that the components of the second image forming section 42 that have functions the same as those of the components of the first image forming section 41 are suitably denoted by the same reference signs.

[Second Intermediate Transfer Belt 72]

The second intermediate transfer belt 72 is configured in a similar manner to the first intermediate transfer belt 71 of the first image forming section 41. The second intermediate transfer belt 72 has a function of transporting toner images that have been transferred thereto from the photoconductor drums 52 for the different colors in the second image forming section 42 to a second second transfer position T22.

More specifically, a portion of the second intermediate transfer belt 72 that is wound around the driving roller 74A defines a contact region (a nip region) 72N by being in contact with the transport belt 20. The contact region 72N corresponds to the second second transfer position T22 at which toner images on the second intermediate transfer belt 72 are transferred onto one of the recording media P.

In the contact region 72N, the second intermediate transfer belt 72 has a function of nipping, together with the transport belt 20, one of the recording medium P that has been nipped between the first intermediate transfer belt 71 and the transport belt 20. In other words, the second intermediate transfer belt 72 has a function of nipping one of the recording media P together with the transport belt 20 while the recording medium P is nipped between the first intermediate transfer belt 71 and the transport belt 20.

To be more specific, the second intermediate transfer belt 72 and the first intermediate transfer belt 71 overlap each other in the direction of gravity (i.e., overlap each other vertically). More specifically, the second intermediate transfer belt 72 is disposed above the first intermediate transfer belt 71 in such a manner as to overlap the first intermediate transfer belt 71 in the direction of gravity.

[Toners Used in First Image Forming Section 41 and Second Image Forming Section 42]

The toner image forming units 50(Y), 50(M), and 50(C) in the first image forming section 41 use normal toners, which will be described later. The toner image forming unit 50(W) in the first image forming section 41 uses white toner, which will be described later.

The toner image forming units 50(T) and 50(K) in the second image forming section 42 use normal toners, which will be described later. The toner image forming units 50(S) and 50(G) in the second image forming section 42 each use a flat toner 100, which will be described below.

[Flat Toner 100]

Figure 7:
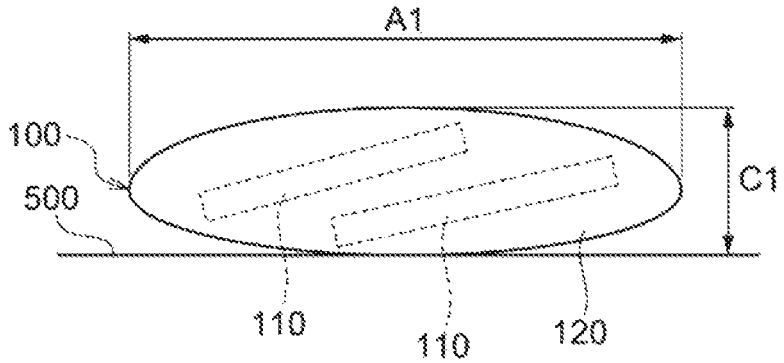
FIG. 7 is a side view of a particle of the flat toner according to the present exemplary embodiment.

As illustrated in FIG. 7, the flat toner 100 contains a flat pigment 110 and a binder resin 120. The flat pigment 110 is made of aluminum (an example of a metal). A commonly known resin material is used for the binder resin 120.

As mentioned above, the flat pigment 110 is made of aluminum (an example of a metal) and is also a metal pigment. Thus, the flat toner 100 is also a metal toner containing a metal pigment.

Figure 5:
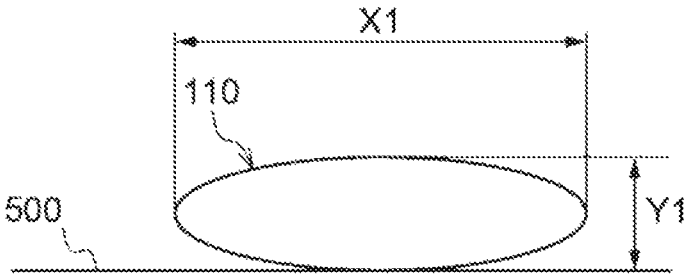
FIG. 5 is a side view of a flat pigment particle that is contained in a flat toner according to the present exemplary embodiment.

As illustrated in FIG. 5, when a particle of the flat pigment 110 is placed on a flat surface 500 and is viewed from the side, the flat pigment particle 110 has a dimension X1 in the transverse direction that is longer than its dimension Y1 in the vertical direction.

Figure 6:
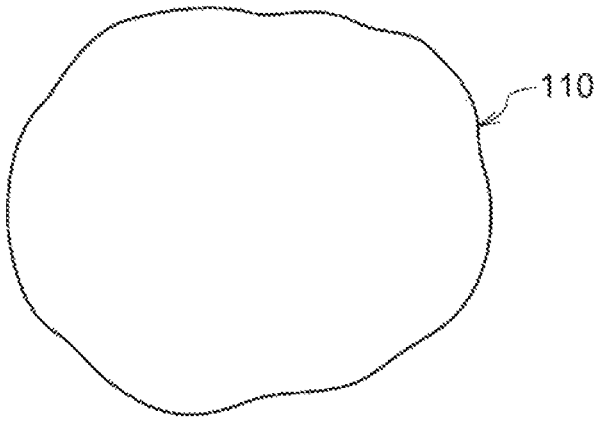
FIG. 6 is a plan view of the flat pigment particle contained in the flat toner according to the present exemplary embodiment.

In addition, when the flat pigment particle 110 illustrated in FIG. 5 is viewed from above, as illustrated in FIG. 6, the flat pigment particle 110 has a shape wider than its shape when viewed from the side. In this manner, each particle of the flat pigment 110 has a flat shape.

Since the particle shape of the flat pigment 110 is a flat shape, the particle shape of the flat toner 100 containing the flat pigment 110 is also a flat shape in such a manner as to follow the particle shape of the flat pigment 110. Thus, when a particle of the flat toner 100 is placed on the flat surface 500 and is viewed from the side, the flat toner particle 100 has a dimension A1 in the transverse direction that is longer than its dimension C1 in the vertical direction as illustrated in FIG. 7.

Figure 8:
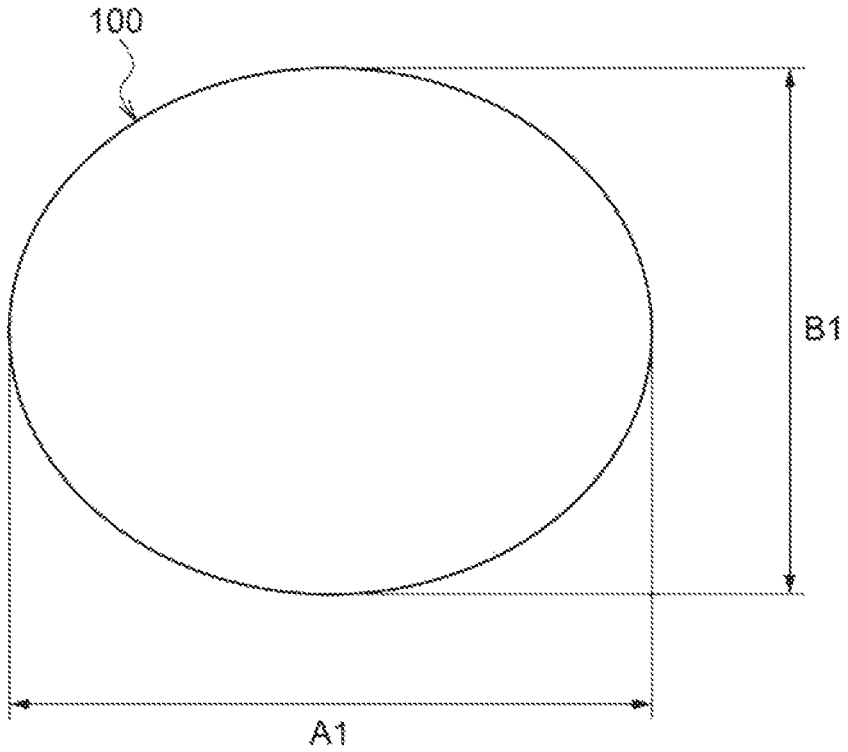
FIG. 8 is a plan view of the particle of the flat toner according to the present exemplary embodiment.

In addition, when the flat toner particle 100 illustrated in FIG. 7 is viewed from above, as illustrated in FIG. 8, the flat toner particle 100 has a substantially circular shape (a substantially elliptical shape) that is wider than its shape when viewed from the side.

A maximum length A1 (the longest diameter) of the flat toner particle 100 when the flat toner particle 100 is viewed from above, a perpendicular length B1 that is perpendicular to the maximum length A1, and a thickness C1 of the flat toner particle 100 when the flat toner particle 100 is viewed from the side (a dimension of the flat toner 100 in the vertical direction) have a relationship of $A1 \geq B1 > C1$.

The maximum length A1 is obtained by magnifying and observing the flat toner particle 100 with a color laser microscope "VK-9700" (manufactured by KEYENCE CORPORATION) and then calculating the maximum length of the flat surface of the toner particle with image processing software.

The maximum length A1 of each particle of the flat toner 100 is set to, for example, 6 μm or more and 16 μm or less.

Note that it is desirable that the value of "thickness C1/perpendicular length B1" be in the range of 0.001 or more and 0.500 or less. When the value of "thickness C1/perpendicular length B1" is 0.001 or more, the strength of the flat toner 100 is ensured, and breakage of the flat toner 100 due to stress that is applied to the flat toner 100 when image formation is performed is suppressed. In addition, deterioration in the chargeability of the flat toner 100 due to exposure of the pigment is suppressed, and fogging that occurs as a result of such deterioration in the chargeability of the flat toner 100 is suppressed. In contrast, when the value of "thickness C1/perpendicular length B1" is 0.500 or less, a favorable metallic luster is obtained.

Note that the toner used by the toner image forming unit 50(G) is gold toner that is formed by adding, for example, yellow pigment to aluminum, which is the flat pigment 110.

[White Toner 200]

Figure 11:
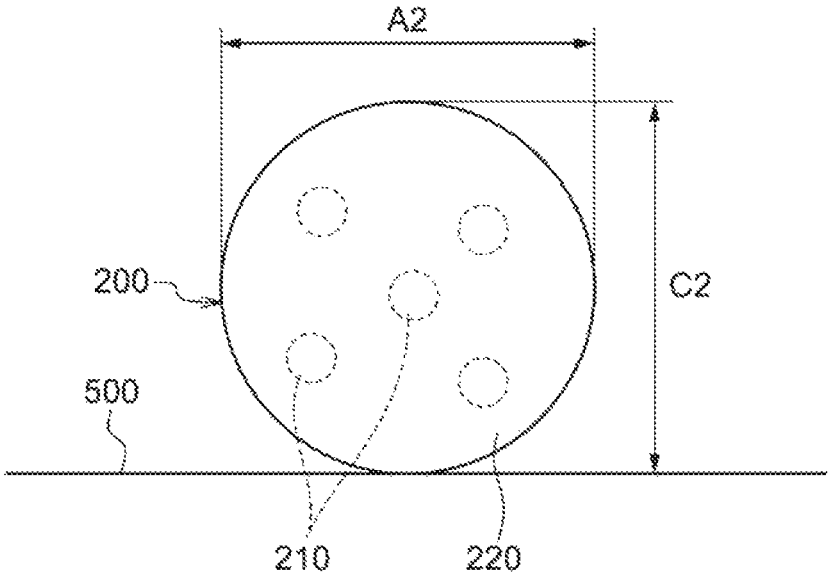
FIG. 11 is a side view of a particle of the white toner according to the present exemplary embodiment.

As illustrated in FIG. 11, the white toner 200 contains a spherical pigment 210 and a binder resin 220. The spherical pigment 210 is made of titanium oxide (an example of a metal oxide). A commonly known resin material is used for the binder resin 220.

As described above, the spherical pigment 210 is made of titanium oxide (an example of a metal oxide) and is also a metal pigment. Thus, the white toner 200 is also a metal toner containing a metal pigment.

Figure 9:
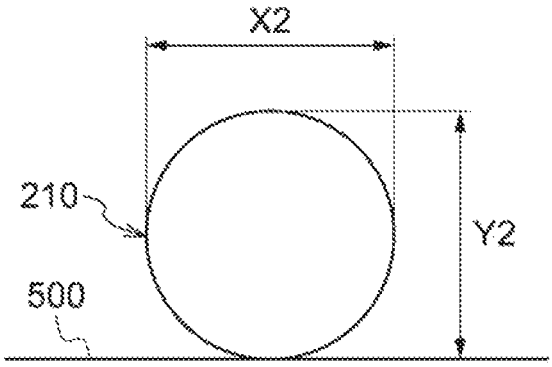
FIG. 9 is a side view of a spherical pigment particle contained in white toner according to the present exemplary embodiment.
Figure 10:
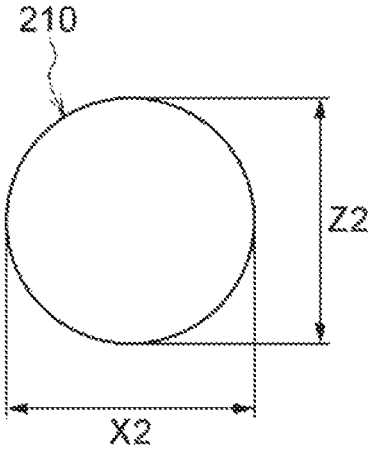
FIG. 10 is a plan view of the spherical pigment particle contained in the white toner according to the present exemplary embodiment.

As illustrated in FIG. 9, when a particle of the spherical pigment 210 is placed on the flat surface 500, a dimension X2 in the transverse direction and a dimension Y2 in the vertical direction of the spherical pigment particle 210 when the spherical pigment particle 210 is viewed from the side as illustrated in FIG. 9 are respectively equal to the dimension X2 in the transverse direction and a dimension Z2 in the longitudinal direction of the spherical pigment particle 210 when the spherical pigment particle 210 is viewed from above as illustrated in FIG. 10.

Thus, the dimensional ratio between the dimension X2 in the transverse direction and the dimension Y2 in the vertical direction of the spherical pigment particle 210 when the spherical pigment particle 210 is viewed from the side as illustrated in FIG. 9 is smaller than that of each particle of the flat pigment 110. In other words, the particle shape of the spherical pigment 210 is closer to a spherical shape than the particle shape of the flat pigment 110 is.

Figure 12:
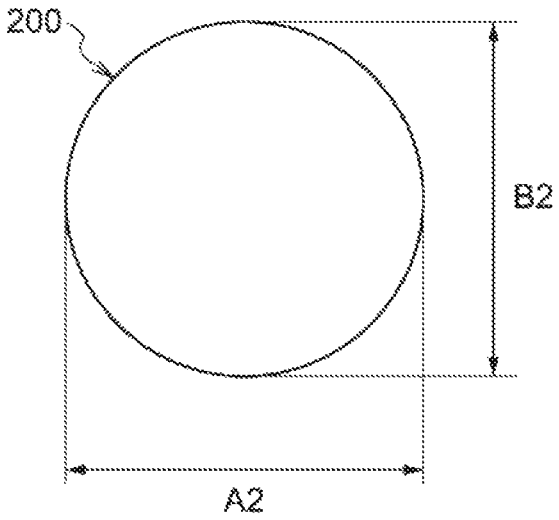
FIG. 12 is a plan view of the particle of the white toner according to the present exemplary embodiment.

Similar to the particle shape of the spherical pigment 210, the particle shape of the white toner 200 containing the spherical pigment 210 is also a spherical shape. Thus, as illustrated in FIG. 11, when a particle of the white toner 200 is placed on the flat surface 500, a dimension A2 in the transverse direction and a dimension C2 in the vertical direction of the white toner particle 200 when the white toner particle 200 is viewed from the side as illustrated in FIG. 11 are respectively equal to the dimension A2 in the transverse direction and a dimension B2 in the longitudinal direction of the white toner particle 200 when the white toner particle 200 is viewed from above as illustrated in FIG. 12.

The particle diameter of the white toner 200 is smaller than that of the flat toner 100. In the present exemplary embodiment, the particle diameters of the toners are compared with one another by the maximum lengths of the toner particles. Thus, the maximum length of each particle of the white toner 200 is set to be shorter than the maximum length A1 of each particle of the flat toner 100. The particle shape of the white toner 200 is considered as a spherical shape, and the volume average particle diameter of the white toner 200 is set to be the maximum length of each particle of the white toner 200.

The volume average particle diameter is measured by using a measuring instrument such as, for example, a Coulter Counter TAII (manufactured by Beckman Coulter, Inc.), or a Multisizer II (manufactured by Beckman Coulter, Inc.). More specifically, a particle size range (a channel) is obtained by dividing the particle size distribution measured by the measuring instrument into ranges, and a cumulative distribution is drawn, on a volumetric basis, on the particle size range (channel) starting from the smaller diameter side. Then, the particle diameter (D50v) at which the cumulative percentage is 50% is set to the volume average particle diameter. Note that the volume average particle diameters that will be mentioned below are also measured in a manner similar to the above.

The volume average particle diameter of the white toner 200 is set to 4 μm or more and 14 μm or less, desirably 5 μm or more and 12 μm or less, and more desirably 6 μm or more and 10 μm or less. When this volume average particle diameter exceeds 14 μm, it becomes difficult to maintain a favorable chargeability (charge amount or charge distribution) of the white toner 200 or a suitable chargeability of the white toner 200 for a long period of time, and effect of improving the reproducibility of fine dots, gradation, and graininess decreases. In contrast, when this volume average particle diameter is less than 4 μm, the fluidity of the toner deteriorates, and in addition, the ability of being electrically charged imparted to the toner by a carrier is likely to be insufficient. Consequently, there is a possibility that background fog will occur or that the density reproducibility will deteriorate or may easily deteriorate.

Note that the concentration (content) of the spherical pigment 210 in the white toner 200 is set to, for example, 20% by mass or more and 50% by mass or less.

[Normal Toner 300]

Figure 15:
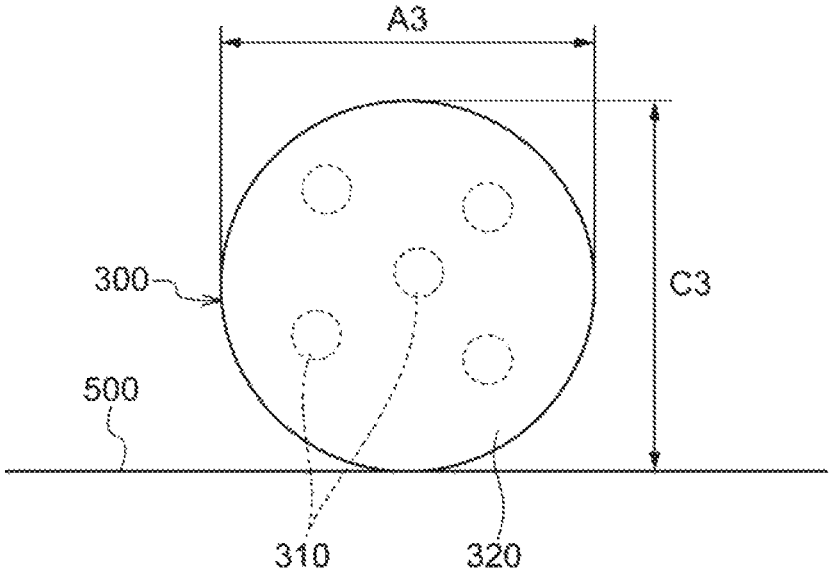
FIG. 15 is a side view of a particle of the normal toner according to the present exemplary embodiment.

As illustrated in FIG. 15, the normal toner 300 does not contain the flat pigment 110 or the spherical pigment 210 and contains a pigment 310 that is different from the flat pigment 110 and the spherical pigment 210 and a binder resin 320. For example, a pigment that is a nonmetal or a nonmetal oxide (e.g., an organic pigment or the like) is used as the pigment 310. In other words, the normal toner 300 contains a pigment having an electrical conductivity lower than that of each of the flat pigment 110 and the spherical pigment 210. A commonly known resin material is used for the binder resin 320.

Figure 13:
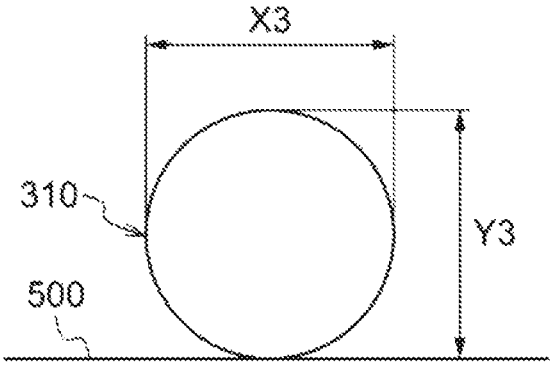
FIG. 13 is a side view of a pigment particle contained in a normal toner according to the present exemplary embodiment.
Figure 14:
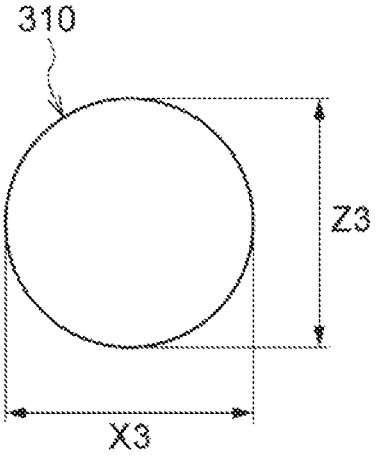
FIG. 14 is a plan view of the pigment particle contained in the normal toner according to the present exemplary embodiment.

As illustrated in FIG. 13, when a particle of the pigment 310 is placed on the flat surface 500, a dimension X3 in the transverse direction and a dimension Y3 in the vertical direction of the pigment particle 310 when the pigment particle 310 is viewed from the side as illustrated in FIG. 13 are respectively equal to the dimension X3 in the transverse direction and a dimension Z3 in the longitudinal direction of the pigment particle 310 when the pigment particle 310 is viewed from above as illustrated in FIG. 14.

Thus, the dimensional ratio between the dimension X3 in the transverse direction and the dimension Y3 in the vertical direction of the pigment particle 310 when the pigment particle 310 is viewed from the side as illustrated in FIG. 13 is smaller than that of each particle of the flat pigment 110. In other words, the particle shape of the pigment 310 is closer to a spherical shape than the particle shape of the flat pigment 110 is.

Figure 16:
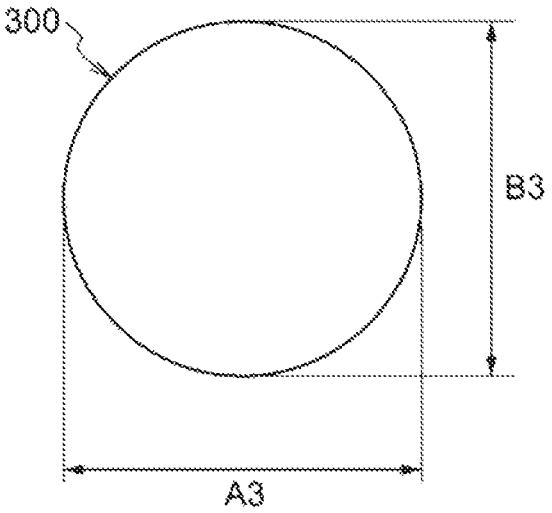
FIG. 16 is a plan view of the particle of the normal toner according to the present exemplary embodiment.

Similar to the particle shape of the pigment 310, the particle shape of the normal toner 300 containing the pigment 310 is also a spherical shape. Thus, as illustrated in FIG. 15, when a particle of the normal toner 300 is placed on the flat surface 500, a dimension A3 in the transverse direction and a dimension C3 in the vertical direction of the normal toner particle 300 when the normal toner particle 300 is viewed from the side as illustrated in FIG. 15 are respectively equal to the dimension A3 in the transverse direction and a dimension B3 in the longitudinal direction of the normal toner particle 300 when the normal toner particle 300 is viewed from above as illustrated in FIG. 16.

The particle diameter of the normal toner 300 is smaller than that of the white toner 200. In the present exemplary embodiment, the particle diameters of the toners are compared with one another by the maximum lengths of the toner particles. Thus, the maximum length of each particle of the normal toner 300 is set to be shorter than the maximum length (volume average particle diameter) of each particle of the white toner 200. The particle shape of the normal toner 300 is considered as a spherical shape, and the volume average particle diameter of the normal toner 300 is set to be the maximum length of each particle of the normal toner 300. Note that the above-mentioned method is used for measuring the volume average particle diameter.

The volume average particle diameter of the normal toner 300 is desirably 3 μm or more and 9 μm or less, and more desirably 3 μm or more and 8 μm or less. When the volume average particle diameter is less than 3 μm, the chargeability of the normal toner 300 becomes insufficient, and the developability may sometimes deteriorate. When the volume average particle diameter exceeds 9 μm, the resolution of an image may sometimes decrease.

Note that the concentration (content) of the pigment 310 in the normal toner 300 is set to, for example, 5% by mass or more and 20% by mass or less.

Note that a compound including a metallic element having a valence of two or more may be added to the normal toner 300. This compound is added as a coagulating agent when the normal toner 300 is produced by an emulsion polymerization coagulating method. The content of the compound in the normal toner 300 is set to, for example, 0.05% by mass or more and 2% by mass or less.

As described above, although the normal toner 300 may contain a metal or a metal oxide, the content (% by mass) of the metal or the metal oxide in the normal toner 300 is set to be smaller than that in the flat toner 100 and that in the white toner 200, and the normal toner 300 has an electrical conductivity as a toner that is lower than that of the flat toner 100 and that of the white toner 200.

Note that the normal toner 300 may be a polymerized toner (a chemical toner) that is obtained by a polymerization method such as an emulsion polymerization coagulating method or may be a ground toner that is obtained by a grinding method. Similarly, the flat toner 100 and the white toner 200 may each be a polymerized toner (a chemical toner) or may be a ground toner that is obtained by a grinding method.

As described above, the particle diameters of the toners that are used in the present exemplary embodiment have a relationship of normal toner 300<white toner 200<flat toner 100.

In the present exemplary embodiment, since the flat toner 100 and the white toner 200 each contain a metal pigment having electrical conductivity, charge injection is likely to occur during a transfer process. The likelihood that an electric charge will be injected into each of the toners used in the present exemplary embodiment satisfies a relationship of normal toner 300<white toner 200<flat toner 100.

In present exemplary embodiment, although each of the toners is triboelectrically-charged in the developing device 56, as the particle diameter of the toner increases, and the particle shape of the toner becomes more non-circular (i.e., more distorted), friction is less likely to be generated, and the chargeability of the toner becomes lower. Thus, the properties of being electrically charged of the toners used in the present exemplary embodiment have a relationship of normal toner 300>white toner 200>flat toner 100. Note that, if the chargeability of a toner is low, the polarity of the toner is likely to be inverted to the opposite polarity when charge injection occurs.

[Second Transfer Rollers 47 and 48]

As illustrated in FIG. 2, the two second transfer rollers 47 and 48 are arranged in a space enclosed by the transport belt 20 (on the inner periphery side of the transport belt 20). Specifically, the second transfer roller 47 is disposed in such a manner as to face the first intermediate transfer belt 71 with the transport belt 20 interposed therebetween, and the second transfer roller 48 is disposed in such a manner as to face the second intermediate transfer belt 72 with the transport belt 20 interposed therebetween. More specifically, the second transfer roller 47 nips the transport belt 20 and the first intermediate transfer belt 71 together with the driving roller 74A of the first image forming section 41 in the contact region 71N (at the first second transfer position T21). The second transfer roller 48 nips the transport belt 20 and the second intermediate transfer belt 72 together with the driving roller 74A of the second image forming section 42 in the contact region 72N (at the second second transfer position T22).

The second transfer roller 47 has a function of transferring toner images that are transferred to the first intermediate transfer belt 71 onto the recording media P, and the second transfer roller 48 has a function of transferring toner images that are transferred to the second intermediate transfer belt 72 onto the recording media P. In the present exemplary embodiment, a second transfer voltage is applied between the second transfer roller 47 and the driving roller 74A of the first image forming section 41, so that a plurality of toner images (hereinafter referred to as "first toner images") that have been superposed with one another on the first intermediate transfer belt 71 are transferred, in a second transfer process, onto an image surface of one of the recording media P at the first second transfer position T21. As a result, the plurality of first toner images are electrostatically held on the image surface of the recording medium P, and the recording medium P is charged.

In addition, a second transfer voltage (hereinafter referred to as "second transfer voltage A") is applied between the second transfer roller 48 and the driving roller 74A of the second image forming section 42, so that a plurality of toner images (hereinafter referred to as "second toner images") that have been superposed with one another on the second intermediate transfer belt 72 are transferred, in the second transfer process, onto an image surface of one of the recording media P at the second second transfer position T22. As a result, the plurality of second toner images are electrostatically held on the image surface of the recording medium P. Note that, in the present exemplary embodiment, the voltage that is applied to the second transfer roller 48 is a transfer voltage having a negative polarity.

Here, the first toner images and the second toner images are charged images. The first toner images that are transferred from the first intermediate transfer belt 71 onto one of the recording media P are each an example of a first charged image. The second toner images that are transferred from the second intermediate transfer belt 72 onto one of the recording media P are each an example of a second charged image.

Note that the plurality of charged images include, for example, a plurality of charged images formed by using toners of different colors, a plurality of charged images formed by using toners that contain different materials such as pigments, a plurality of charged images formed by using toners that have different particle diameters, and a plurality of charged images that are an arbitrary combination of the above-mentioned charged images. In addition, the plurality of charged images may be a plurality of charged images formed by using the same color toner, a plurality of charged images formed by using toners that contain the same material such as a pigment, or a plurality of charged images formed by using toners that have the same particle diameter.

It is not necessary for the plurality of charged images that are superposed with one another on one of the recording media P to be completely overlap one another, and the plurality of charged images may partially overlap one another on the recording medium P. In addition, all the types of the plurality of charged images are not necessarily superposed with one another on one of the recording media P, and only some types of them may be superposed with one another on the recording medium P.

An image surface of each of the recording media P is a surface on which toner images are to be held and is an example of a holding surface. The second transfer roller 48 is an example of a transfer unit. Note that a combination of the second transfer roller 48 and the driving roller 74A, which is a roller facing the second transfer roller 48, may be considered as an example of a transfer unit. In addition, the second transfer roller 47 and the second transfer roller 48 may be respectively considered as an example of a first transfer unit and an example of a second transfer unit.

[Arrangements of Toner Image Forming Units 50 in First and Second Image Forming Sections 41 and 42]

In the present exemplary embodiment, the first image forming section 41 includes the toner image forming units 50 each of which corresponds to one of the four colors of yellow (Y), magenta (M), cyan (C), and white (W) as the four toner image forming units 50, and the second image forming section 42 includes the toner image forming units 50 each of which corresponds to one of the four colors of transparent (T), silver (S), gold (G), and black (K) as the four toner image forming units 50. However, the present disclosure is not limited to this configuration. For example, some or all of the toner image forming units 50 for the different colors included in the first image forming section 41 and may be replaced with some or all of the toner image forming units 50 for the different colors included in the second image forming section 42, and the first image forming section 41 and the second image forming section 42 may include an additional toner image forming unit 50 that corresponds to a color different from the above-mentioned colors. More specifically, for example, the second image forming section 42 may include the toner image forming unit 50(W) corresponding to white, and the first image forming section 41 may include the toner image forming unit 50(S) corresponding to silver and the toner image forming unit 50(G) corresponding to gold. In the present exemplary embodiment, the toner image forming units 50 for the different colors may be arranged at arbitrary positions in the first image forming section 41 and the second image forming section 42.

Figure 17:
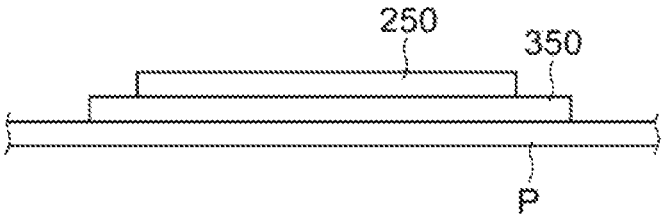
FIG. 17 is a side view illustrating an exemplary multilayer pattern of toner images that are superposed with one another on a recording medium according to the present exemplary embodiment.
Figure 18:
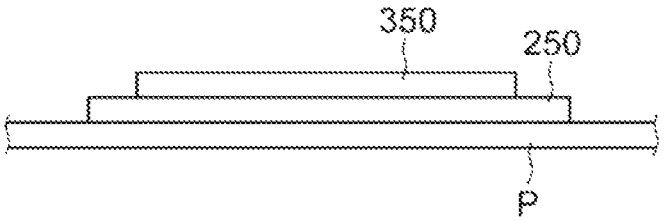
FIG. 18 is a side view illustrating another exemplary multilayer pattern of the toner images superposed with one another on the recording medium according to the present exemplary embodiment.
Figure 19:
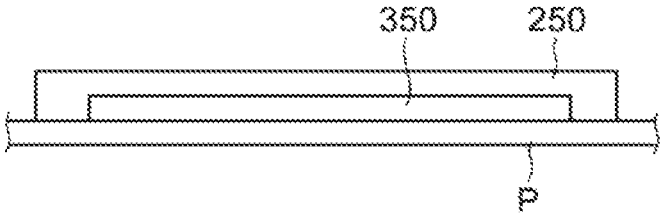
FIG. 19 is a side view illustrating another exemplary multilayer pattern of the toner images superposed with one another on the recording medium according to the present exemplary embodiment.

As described above, by arranging the toner image forming units 50 for the different colors at arbitrary positions in the first image forming section 41 and the second image forming section 42, in the present exemplary embodiment, toner images of the different colors may be arbitrarily superposed on top of one another on one of the recording media P. More specifically, as illustrated in FIG. 17, a white (W) toner image 250 may be superposed on a toner image 350 of a chromatic color, such as yellow (Y), magenta (M), cyan (C), or black (K), on one of the recording media P, which is colored paper, OHP paper, or the like. Alternatively, as illustrated in FIG. 18, the toner image 350 of a chromatic color, which is yellow (Y), magenta (M), cyan (C), or black (K), may be superposed on the white (W) toner image 250 on one of the recording media P, which is colored paper, OHP paper, or the like. Alternatively, as illustrated in FIG. 19, on one of the recording media P that is a transparent sheet, such as OHP paper, the white (W) toner image 250 may be superposed on the toner image 350 of a chromatic color, which is yellow (Y), magenta (M), cyan (C), or black (K), in such a manner as to cover the toner image 350, and the toner image 350 may be visually recognized from a surface of the recording medium P that is opposite to the surface of the recording medium P on which these toner images are superposed with one another. Note that a silver (S) or gold (G) toner image may be used instead of the white (W) toner image 250 illustrated in FIG. 17, FIG. 18, and FIG. 19.

In the present exemplary embodiment, although the first image forming section 41 includes the four toner image forming units 50, the present disclosure is not limited to this configuration. The first image forming section 41 may include two or three toner image forming units 50 or may include five or more toner image forming units 50. Alternatively, the first image forming section 41 may include one toner image forming unit 50. In other words, a configuration may be employed in which a single toner image is transferred, in the second transfer process, onto an image surface of one of the recording media P from the first intermediate transfer belt 71 at the first second transfer position T21. In this configuration, a single toner image is electrostatically held on an image surface of one of the recording media P at the first second transfer position T21.

In the present exemplary embodiment, although the second image forming section 42 includes the four toner image forming units 50, the present disclosure is not limited to this configuration. The second image forming section 42 may include two or three toner image forming units 50 or may include five or more toner image forming units 50. In other words, the second image forming section 42 may include a plurality of toner image forming units 50.

(Fixing Device 19)

The fixing device 19 illustrated in FIG. 1 functions as a fixing unit that fixes an image transferred to a recording medium onto the recording medium. Specifically, the fixing device 19 is a device that fixes toner images that have been transferred to one of the recording media P by the second transfer rollers 47 and 48 onto the recording medium P. More specifically, as illustrated in FIG. 1, the fixing device 19 includes a heating roller 92 that serves as a heating member and a pressure roller 94 that serves as a pressing member. The fixing device 19 applies heat and pressure to one of the recording media P while the heating roller 92 and the pressure roller 94 nip and transports the recording medium P, so that toner images formed on the recording medium P are fixed onto the recording medium P.

(Static Eliminating Rollers 81 and 82)

The static eliminating rollers 81 and 82 illustrated in FIG. 2 are each an example of a static eliminating unit that remove static electricity from one of the recording media P holding the first toner images. The static eliminating rollers 81 and 82 are arranged between the first second transfer position T21 and the second second transfer position T22. In other words, the static eliminating rollers 81 and 82 are positioned upstream from the second transfer roller 48 in the transport direction of the recording media P. More specifically, the static eliminating roller 81 is positioned on the lower side in a region between the first second transfer position T21 and the second second transfer position T22. The static eliminating roller 82 is positioned on the upper side in the region between the first second transfer position T21 and the second second transfer position T22.

A distance L1 between the static eliminating roller 81 and the first second transfer position T21 is shorter than a distance L2 between the static eliminating roller 81 and the second second transfer position T22. In other words, it may be said that the static eliminating rollers 81 and 82 are closer to the first second transfer position T21 than the second second transfer position T22. In addition, the distance L1 is shorter than a distance L3 between the first second transfer position T21 and the second second transfer position T22. Note that the distance L2 is equal to the distance L3. In the present exemplary embodiment, each of the distances L1, L2, and L3 is a distance between the centers of the corresponding rollers (the axes of the corresponding rollers).

To be more specific, the static eliminating rollers 81 and 82 are arranged in the space enclosed by the transport belt 20 (on the inner periphery side of the transport belt 20). More specifically, the static eliminating rollers 81 and 82 are arranged on an opposite surface 20B (an example of an inner circumferential surface) of the transport belt 20 that is opposite to the contact surface 20A of the transport belt 20. In other words, the static eliminating rollers 81 and 82 are in contact with the opposite surface 20B.

The static eliminating rollers 81 and 82 are driven and rotated as a result of being in contact with the opposite surface 20B of the transport belt 20. In other words, the static eliminating rollers 81 and 82 are driven rollers that are driven by the transport belt 20 so as to rotate.

For example, electrical power is supplied to the static eliminating rollers 81 and 82 from the high-voltage power supply board 66 of the first image forming section 41, so that a voltage is applied between the second transfer roller 47 and the static eliminating rollers 81 and 82. In this manner, as a result of power being applied to the static eliminating rollers 81 and 82, the static eliminating rollers 81 and 82 apply an electric charge having a polarity opposite to the polarity of one of the recording media P that is charged at the first second transfer position T21 to the recording medium P so as to remove static electricity from the recording medium P.

As described above, since the static eliminating rollers 81 and 82 are in contact with the opposite surface 20B of the transport belt 20, in the present exemplary embodiment, the static eliminating rollers 81 and 82 remove static electricity from each of the recording media P via the transport belt 20.

Note that the wording "remove static electricity" refers to at least partially removing (neutralizing) electric charges from the recording media P that have been charged and is not limited to completely removing electric charges. In other words, it is only necessary that the amount of charge carried by the recording medium P be reduced and that the electrostatic force be reduced. Regarding the voltage that is applied to the static eliminating rollers 81 and 82 in the present exemplary embodiment, either a positive voltage or a negative voltage is applied to the static eliminating rollers 81 and 82 depending on the type of the recording media P.

(Drive Control of Static Eliminating Rollers 81 and 82)

In the present exemplary embodiment, the control board 64 serving as a receiving unit that receives information regarding the recording media P changes the voltage to be applied to the static eliminating rollers 81 and 82 on the basis of information regarding the recording media P received by the control board 64. More specifically, for example, the control board 64 of the first image forming section 41 receives information regarding the type of the recording media P (hereinafter referred to as "type information of the recording media P"), and the control board 64 controls driving of the high-voltage power supply board 66 on the basis of the type information of the recording media P and changes the voltage to be applied to the static eliminating rollers 81 and 82 (see FIG. 4).

The type information of the recording media P is an example of information regarding the recording media P and is information that indicates the type of the recording media P. For example, the type of the recording media P is selected through the UI 17, so that the control board 64 of the first image forming section 41 receives the type information of the recording media P. Note that the control board 64 may receive the type information of the recording media P from an external device that is connected to the image forming apparatus 10. Alternatively, the type (e.g., electrical resistance) of the recording media P may be detected by a detection unit such as a sensor, and the detection result may be received as the type information of the recording media P.

For example, when the type of the recording media P indicated by the type information of the recording media P that is received by the control board 64 is a high-resistance type, that is, when the recording media P each have a high electrical resistance, the control board 64 performs control so as to cause the high-voltage power supply board 66 to apply a voltage to the static eliminating rollers 81 and 82. More specifically, in the present exemplary embodiment, for example, when the type of the recording media P indicated by the type information of the recording media P that is received by the control board 64 is the high-resistance type, the control board 64 increases the voltage to be applied to the static eliminating rollers 81 and 82 to be higher than that in the case where the type of the recording media P is not the high-resistance type.

In other words, for example, the control board 64 performs control so as to cause the high-voltage power supply board 66 to apply a first voltage to the static eliminating rollers 81 and 82 when the type of the recording media P indicated by the type information of the recording media P that is received by the control board 64 is a first type and to apply a second voltage that is higher than the first voltage to the static eliminating rollers 81 and 82 when the type of the recording media P indicated by the received type information of the recording media P is a second type that has a higher electrical resistance than the first type. This control increases the amount of charge carried by each of the static eliminating rollers 81 and 82, so that the ability of each of the static eliminating rollers 81 and 82 to remove static electricity is improved.

Here, examples of the high-resistance type include OHP paper and thick paper. Note that a black sheet is not included in the high-resistance type because the electrical resistance of a black sheet is low. The high-resistance type refers to the type of recording media each having a surface resistance higher than that of a normal sheet. In addition, the high-resistance type refers to the type of recording media each having a surface resistance value of 14 (log Ω) or higher.

Note that, in the present exemplary embodiment, the control board 64 may perform control so as to, for example, cause the high-voltage power supply board 66 not to apply a voltage to the static eliminating rollers 81 and 82 when the type of the recording media P indicated by the type information of the recording media P that is received by the control board 64 is the first type and to apply a voltage to the static eliminating rollers 81 and 82 when the type of the recording media P indicated by the received type information of the recording media P is the second type, which has a higher electrical resistance than the first type.

In the present exemplary embodiment, although electrical power is supplied to the static eliminating rollers 81 and 82 from the high-voltage power supply board 66 of the first image forming section 41, the present disclosure is not limited to this configuration. For example, the high-voltage power supply board 66 of the second image forming section 42 may serve as a power supply that supplies power to the static eliminating rollers 81 and 82. Alternatively, the high-voltage power supply board 66 of the first image forming section 41 may supply power to one of the static eliminating rollers 81 and 82, and the high-voltage power supply board 66 of the second image forming section 42 may supply power to the other of the static eliminating rollers 81 and 82. Alternatively, electrical power may be supplied to the static eliminating rollers 81 and 82 from a power supply that is provided in the apparatus body 11 separately from the high-voltage power supply board 66 of the first image forming section 41 and the high-voltage power supply board 66 of the second image forming section 42.

(Control of Second Transfer Voltage A)

In the present exemplary embodiment, the control board 64 controls the second transfer voltage A that is applied between the second transfer roller 48 and the driving roller 74A of the second image forming section 42. More specifically, the control board 64 controls the second transfer voltage A on the basis of the toners included in the second toner images.

As a result, in the present exemplary embodiment, when the second toner images that include the flat toner 100 containing the flat pigment 110 are transferred onto one of the recording media P, the second transfer voltage A is set to a transfer voltage lower than the transfer voltage in the case where the second toner images that do not include the flat toner 100 are transferred onto one of the recording media P.

More specifically, when the second toner images including a toner image formed by at least one of the toner image forming unit 50(S) corresponding to silver and the toner image forming unit 50(G) corresponding to gold are transferred onto one of the recording media P, the second transfer voltage A is set to a transfer voltage lower than the transfer voltage in the case where the second toner images that do not include a toner image formed by the toner image forming unit 50(S) corresponding to silver or a toner image formed by the toner image forming unit 50(G) corresponding to gold are transferred onto one of the recording media P.

In the present exemplary embodiment, as described above, the particle diameter of the flat toner 100 is larger than that of the normal toner 300. Thus, in the present exemplary embodiment, it may also be said that, when the second toner images that include a toner whose particle diameter is larger than that of the normal toner 300 are transferred onto one of the recording media P, the second transfer voltage A is set to a transfer voltage lower than the transfer voltage in the case where the second toner images that do not include the toner whose particle diameter is larger than that of the normal toner 300 are transferred onto one of the recording media P.

In the present exemplary embodiment, as described above, the flat pigment 110 contained in the flat toner 100 is also a metal pigment. Thus, in the present exemplary embodiment, it may also be said that, when the second toner images that include a toner containing a metal pigment are transferred onto one of the recording media P, the second transfer voltage A is set to a transfer voltage lower than the transfer voltage in the case where the second toner images that do not include a toner containing a metal pigment are transferred onto one of the recording media P.

In addition, the control board 64 controls the second transfer voltage A on the basis of the type of the recording media P. More specifically, when the type of the recording media P is the high-resistance type, the second transfer voltage A is set to a transfer voltage higher than the transfer voltage in the case where the type of the recording media P is not the high-resistance type.

Note that, in the case (hereinafter referred to as "case A") where the type of the recording media P is the high-resistance type and where the second toner images including a toner image formed by at least one of the toner image forming unit 50(S) corresponding to silver and the toner image forming unit 50(G) corresponding to gold are transferred onto one of the recording media P, the second transfer voltage A is set in the following manner. In other words, in the case A, when priority is given to elimination of the influence of the fact that the type of the recording media P is the high-resistance type, the second transfer voltage A is set to a transfer voltage higher than the transfer voltage in the case where the type of the recording media P is not the high-resistance type. In addition, in the case A, when priority is given to elimination of the influence of the fact that the second toner images include a toner image formed by at least one of the toner image forming unit 50(S) corresponding to silver and the toner image forming unit 50(G) corresponding to gold, the second transfer voltage A is set to a transfer voltage lower than the transfer voltage in the case where the second toner images that do not include a toner image formed by the toner image forming unit 50(S) corresponding to silver or a toner image formed by the toner image forming unit 50(G) corresponding to gold are transferred onto one of the recording media P.

Note that, in the case where the second image forming section 42 includes the toner image forming unit 50(W) corresponding to white, when the second toner images that include the white toner 200 are transferred onto one of the recording media P, the second transfer voltage A may be set to a transfer voltage lower than the transfer voltage in the case where the second toner images that do not include the white toner 200 are transferred onto one of the recording media P. This configuration will hereinafter be referred to as "modification A".

As described above, the particle diameter of the white toner 200 is larger than that of the normal toner 300. Thus, in the modification A, it may also be said that, when the second toner images that include a toner whose particle diameter is larger than that of the normal toner 300 are transferred onto one of the recording media P, the second transfer voltage A is set to a transfer voltage lower than the transfer voltage in the case where the second toner images that do not include the toner whose particle diameter is larger than that of the normal toner 300 are transferred onto one of the recording media P.

As described above, the spherical pigment 210 contained in the white toner 200 is also a metal pigment. Thus, in the modification A, it may also be said that, when the second toner images that include a toner containing a metal pigment are transferred onto one of the recording media P, the second transfer voltage A is set to a transfer voltage lower than the transfer voltage in the case where the second toner images that do not include a toner containing a metal pigment are transferred onto one of the recording media P.

<Effects According to Present Exemplary Embodiment>

Effects according to the present exemplary embodiment will now be described.

In the present exemplary embodiment, as a result of the second transfer voltage being applied between the second transfer roller 47 and the driving roller 74A of the first image forming section 41, the plurality of first toner images superposed with one another on the first intermediate transfer belt 71 are transferred, at the first second transfer position T21, onto one of the recording media P that is transported upward by the transport belt 20. As a result, the plurality of first toner images are held on the recording medium P, and the recording medium P is charged.

The recording medium P that is charged at the first second transfer position T21 is transported further upward by the transport belt 20, and the static eliminating rollers 81 and 82 remove static electricity from the recording medium P between the first second transfer position T21 and the second second transfer position T22. After the static eliminating rollers 81 and 82 have removed static electricity from the recording medium P, the recording medium P is transported further upward by the transport belt 20, and the plurality of second toner images superposed with one another on the second intermediate transfer belt 72 are transferred, at the second second transfer position T22, onto the recording medium P as a result of the second transfer voltage A being applied between between the second transfer roller 48 and the driving roller 74A of the second image forming section 42.

Here, a configuration (hereinafter referred to as "first configuration") in which a charged state of one of the recording media P, the charged state being brought when the first toner images are held on the recording medium P, is continuously maintained until the second toner images are transferred onto the recording medium P, it is necessary to increase the secondary transfer voltage A in order to increase the potential difference between the second transfer voltage A and the recording medium P. For example, in the first configuration, if the second transfer voltage A is increased to be higher than an allowable value, electric discharge occurs between the second transfer voltage A and the recording medium P, and there is a possibility that the first toner images held on the recording medium P will be scattered, so that irregularities will occur in the first toner images. In contrast, in the first configuration, if the second transfer voltage A is decreased to be lower than an allowable value, the electrostatic force becomes weak, and there is a possibility that a failure will occur in which the second toner images are not appropriately transferred, so that irregularities will occur in the second toner images.

In contrast, in the present exemplary embodiment, since the static eliminating rollers 81 and 82 remove static electricity from the recording media P, the range of the allowable value of the second transfer voltage A is wider than that in the first configuration, and occurrence of irregularities in toner images (specifically, either or both of the first toner images or the second toner images) is suppressed.

In particular, in the present exemplary embodiment, since the plurality of first toner images are held on one of the recording media P, irregularities occurred in the first toner images may be visually recognized more easily compared with a configuration in which a single first toner image is held on one of the recording media P. In other words, in the present exemplary embodiment, in the configuration in which irregularities occurred in toner images are easily visible, occurrence of irregularities in toner images is more suppressed compared with the first configuration.

In the present exemplary embodiment, the static eliminating rollers 81 and 82 are arranged in the space enclosed by the transport belt 20 and remove static electricity from the recording media P via the transport belt 20. Thus, the static eliminating rollers 81 and 82 remove static electricity from the recording media P without coming into contact with each of the recording media P that is transported by the transport belt 20. As described above, since the static eliminating rollers 81 and 82 do not come into contact with the recording media P, compared with the configuration in which the static eliminating rollers 81 and 82 come into contact with the recording media P, separation of each of the recording media P from the transport belt 20 and generation of wrinkles in each of the recording media P are suppressed.

In the present exemplary embodiment, the static eliminating rollers 81 and 82 are driven rollers that are driven and rotated by the transport belt 20 as a result of being in contact with the opposite surface 20B of the transport belt 20. Thus, compared with the configuration in which the static eliminating rollers 81 and 82 slide relative to the transport belt 20, the frictional resistance between the transport belt 20 and each of the static eliminating rollers 81 and 82 is reduced. Note that the term "slide" refers to a state of moving while sliding.

In the present exemplary embodiment, the transport belt 20 transports each of the recording media P upward, and the second intermediate transfer belt 72 and the first intermediate transfer belt 71 are overlap each other in the direction of gravity. Thus, compared with the configuration in which the transport belt 20 transports each of the recording media P in the horizontal direction and in which the entire first intermediate transfer belt 71 does not overlap the second intermediate transfer belt 72 in the direction of gravity but overlaps the second intermediate transfer belt 72 in the horizontal direction, the dimension of the image forming apparatus 10 in the horizontal direction is reduced, and the probability that the transferability of toner images at the second second transfer position T22 will be affected is reduced.

In the present exemplary embodiment, as a result of the voltage being applied to the static eliminating rollers 81 and 82, the static eliminating rollers 81 and 82 apply an electric charge having a polarity opposite to the polarity of one of the recording media P that is charged at the first second transfer position T21 to the recording medium P so as to remove static electricity from the recording medium P. Thus, compared with the configuration in which the static eliminating rollers 81 and 82 each function as a ground that only releases electric charges carried by the recording media P as a result of being grounded to a reference potential (ground), the ability of each of the static eliminating rollers 81 and 82 to remove static electricity is improved.

In the present exemplary embodiment, the control board 64 controls driving of the high-voltage power supply board 66 on the basis of type information of the recording media P and changes the voltage to be applied to the static eliminating rollers 81 and 82. Thus, compared with the configuration in which the voltage to be applied to the static eliminating rollers 81 and 82 is a constant value, the ability of each of the static eliminating rollers 81 and 82 to remove static electricity may be changed in accordance with the recording media P.

Here, when the type of the recording media P is the high-resistance type, each of the recording media P is likely to be charged at the first second transfer position T21. Accordingly, in the present exemplary embodiment, when the type of the recording media P is the high-resistance type, the voltage is applied to the static eliminating rollers 81 and 82, and the static eliminating rollers 81 and 82 remove static electricity from each of the recording media P. Thus, compared with the configuration in which the static eliminating rollers 81 and 82 remove static electricity from the recording media P only when the type of the recording media P is a low-resistance type, occurrence of irregularities in toner images is suppressed.

More specifically, in the present exemplary embodiment, when the type of the recording media P is the high-resistance type, the voltage to be applied to the static eliminating rollers 81 and 82 is set to be higher than that in the case where the type of the recording media P is not the high-resistance type, and thus, compared with the configuration in which the voltage that is applied to the static eliminating rollers 81 and 82 when the type of the recording media P is the high-resistance type is the same as the voltage in the case where the type of the recording media P is not the high-resistance type, the occurrence of irregularities in toner images is suppressed.

In the present exemplary embodiment, when the second toner images that include the flat toner 100 are transferred onto one of the recording media P, the second transfer voltage A is set to a transfer voltage lower than the transfer voltage in the case where the second toner images that do not include the flat toner 100 are transferred onto one of the recording media P.

Here, in a configuration (hereinafter referred to as "second configuration") in which, when the second toner images that include the flat toner 100 are transferred onto one of the recording media P, the second transfer voltage A is set to a transfer voltage the same as the transfer voltage in the case where the second toner images that do not include the flat toner 100 are transferred onto one of the recording media P, since the flat toner 100 contains the flat pigment 110, which is a metal pigment, charge injection is likely to occur.

In addition, since the particle diameter of the flat toner 100 is larger than that of the normal toner 300, and the particle shape of the flat toner 100 is a flat shape because the flat toner 100 contains the flat pigment 110, frictional electrification is less likely to occur, and the chargeability of the flat toner 100 is low. Thus, in the second configuration, when the second toner images are transferred onto one of the recording media P, charge injection occurs in the flat toner 100, and the polarity of the flat toner 100 is likely to be inverted. If the polarity of the flat toner 100 is inverted, a phenomenon (so-called retransfer) in which the flat toner 100 electrostatically repels the recording medium P, so that the second toner images are transferred back onto the second intermediate transfer belt 72 may sometimes occur.

In contrast, in the present exemplary embodiment, as described above, when the second toner images that include the flat toner 100 are transferred onto one of the recording media P, the second transfer voltage A is set to a transfer voltage lower than the transfer voltage in the case where the second toner images that do not include the flat toner 100 are transferred onto one of the recording media P, and thus, charge injection is less likely to occur in the flat toner 100, and a transfer failure (specifically, retransfer) is less likely to occur compared in the second configuration. Thus, according to the present exemplary embodiment, the occurrence of irregularities in toner images is more suppressed than in the second configuration.

In the present exemplary embodiment, when the type of the recording media P is the high-resistance type, the second transfer voltage A is set to a transfer voltage higher than the transfer voltage in the case where the type of the recording media P is not the high-resistance type.

Here, in a configuration (hereinafter referred to as "third configuration") in which, when the type of the recording media P is the high-resistance type, the second transfer voltage A is set to a transfer voltage the same as the transfer voltage in the case where the type of the recording media P is not the high-resistance type, since the type of the recording media P is the high-resistance type, each of the recording media P is likely to be charged, and the potential difference between the second transfer voltage A and each of the recording media P is small. Thus, there is a possibility that the transferability of the second toner images with respect to each of the recording media P will deteriorate.

In contrast, in the present exemplary embodiment, when the type of the recording media P is the high-resistance type, the second transfer voltage A is set to a transfer voltage higher than the transfer voltage in the case where the type of the recording media P is not the high-resistance type, and thus, the transferability of the second toner images with respect to each of the recording media P is improved compared with the third configuration.

<Modifications>

In the present exemplary embodiment, although the static eliminating rollers 81 and 82 are arranged in the space enclosed by the transport belt 20 (on the inner periphery side of the transport belt 20), the present disclosure is not limited to this configuration. For example, a configuration may be employed in which the static eliminating rollers 81 and 82 are arranged in a space outside the transport belt 20 and between the first image forming section 41 and the second image forming section 42. In this configuration, instead of the static eliminating rollers 81 and 82, other static eliminating units are used, and, for example, these static eliminating units are arranged between the first second transfer position T21 and the second second transfer position T22 in such a manner as to be located on the side on which the contact surface 20A of the transport belt 20 is present. In this case, it is necessary to remove static electricity from each of the recording media P without causing irregularities in toner images that are transferred to the recording medium P from the first image forming section 41. Thus, more specifically, the static eliminating units need to be arranged so as to face the contact surface 20A in a non-contact manner, and it is necessary to form an electrical path that extends from an end of each of the static eliminating units in a direction crossing the direction of movement of the transport belt 20 to the inner circumferential surface of the transport belt 20 such that a path for static elimination is formed on the inner circumferential surface of the transport belt 20.

In the present exemplary embodiment, although the static eliminating rollers 81 and 82 are driven rollers that are driven and rotated by the transport belt 20 as a result of being in contact with the opposite surface 20B of the transport belt 20, the present disclosure is not limited to this configuration. For example, the static eliminating rollers 81 and 82 may be configured to slide relative to the transport belt 20, which moves circularly. Examples of a static eliminating unit in this configuration include a static eliminating needle (a detack saw) and a static eliminating film.

In the present exemplary embodiment, although a voltage is applied between the static eliminating rollers 81 and 82 and the second transfer roller 47, the present disclosure is not limited to this configuration. For example, a voltage may be applied between the static eliminating roller 81 and the static eliminating roller 82.

In the present exemplary embodiment, although the transport belt 20 transports each of the recording media P upward, the present disclosure is not limited to this configuration. For example, the transport belt 20 may be configured to transport each of the recording media P downward. Alternatively, the transport belt 20 may be configured to transport each of the recording media P in the horizontal direction.

In the present exemplary embodiment, although the control board 64 changes the voltage to be applied to the static eliminating rollers 81 and 82 on the basis of type information of the recording media P, the present disclosure is not limited to this configuration. For example, the voltage to be applied to the static eliminating rollers 81 and 82 may be set to a constant value.

In the present exemplary embodiment, although a voltage is applied to the static eliminating rollers 81 and 82, the present disclosure is not limited to this configuration. For example, each of the static eliminating rollers 81 and 82 may be configured to function as a ground that releases electric charges carried by the recording media P, which have been charged, as a result of being grounded to the reference potential (ground), and as a static eliminating unit, any unit may be used as long as the unit at least partially removes electric charges from the recording media P, which have been charged.

In the present exemplary embodiment, although the image forming section 14 includes the two image forming units (the first image forming section 41 and the second image forming section 42), the present disclosure is not limited to this configuration. For example, the image forming section 14 may further include a third image forming unit, and the image forming section 14 may include three or more image forming units.

In the present exemplary embodiment, although toner images are transferred by the second transfer rollers 47 and 48 onto one of the recording media P that is transported by the transport belt 20, the present disclosure is not limited to this configuration. For example, toner images may be transferred by the second transfer rollers 47 and 48 onto one of the recording media P that is transported by a transport member such as a transport roller.

In the present exemplary embodiment, although a plurality of toner images superposed with one another on the first intermediate transfer belt 71 are transferred onto an image surface of one of the recording media P at the first second transfer position T21, so that the plurality of toner images are held on the recording medium P, the present disclosure is not limited to this configuration. For example, a configuration may be employed in which a single toner image is transferred onto an image surface of one of the recording media P at the first second transfer position T21, so that the single toner image is held on the recording medium P.

The present disclosure is not limited to the above-described embodiments, and various modifications, changes, and improvements may be made within the gist of the present disclosure. For example, the above-described modifications may be suitably combined with one another.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a transfer roller configured to transfer a plurality of second charged images superposed with one another onto a holding surface of a recording medium on which at least one first charged image has been electrostatically held; and a static eliminating roller disposed upstream from the transfer roller in a transport direction of the recording medium and configured to remove static electricity from the recording medium electrostatically holding the at least one first charged image, wherein the static eliminating roller is disposed on an opposite side of the recording medium with respect to the transfer roller transferring the plurality of second charged images.

2. The image forming apparatus according to claim 1, wherein the at least one first charged image includes a plurality of first charged images, and wherein the transfer roller is configured to transfer the plurality of second charged images superposed with one another onto the holding surface of the recording medium on which the plurality of first charged images have been superposed with one another and electrostatically held.

3. The image forming apparatus according to claim 2, wherein a transfer voltage that is applied to the transfer roller when the second charged images that include a toner containing a metal pigment are transferred onto the recording medium is set to be lower than a transfer voltage that is applied to the transfer roller when the second charged images that do not include the toner are transferred onto the recording medium.

4. The image forming apparatus according to claim 3, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

5. The image forming apparatus according to claim 2, wherein a transfer voltage that is applied to the transfer roller when the second charged images that include a toner having a particle diameter larger than a particle diameter of a normal toner are transferred onto the recording medium is set to be lower than a transfer voltage that is applied to the transfer roller when the second charged images that do not include the toner are transferred onto the recording medium.

6. The image forming apparatus according to claim 5, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

7. The image forming apparatus according to claim 2, wherein a transfer voltage that is applied to the transfer roller when the second charged images that include a toner containing a flat pigment are transferred onto the recording medium is set to be lower than a transfer voltage that is applied to the transfer roller when the second charged images that do not include the toner are transferred onto the recording medium.

8. The image forming apparatus according to claim 2, wherein the static eliminating roller remove static electricity from the recording medium when a type of the recording medium is a high-resistance type.

9. The image forming apparatus according to claim 8, wherein a transfer voltage that is applied to the transfer roller when the type of the recording medium is the high-resistance type is set to be higher than a transfer voltage that is applied to the transfer roller when the type of the recording medium is not the high-resistance type.

10. The image forming apparatus according to claim 2, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

11. The image forming apparatus according to claim 1, wherein a transfer voltage that is applied to the transfer roller when the second charged images that include a toner containing a metal pigment are transferred onto the recording medium is set to be lower than a transfer voltage that is applied to the transfer roller when the second charged images that do not include the toner are transferred onto the recording medium.

12. The image forming apparatus according to claim 11, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

13. The image forming apparatus according to claim 1, wherein a transfer voltage that is applied to the transfer roller when the second charged images that include a toner having a particle diameter larger than a particle diameter of a normal toner are transferred onto the recording medium is set to be lower than a transfer voltage that is applied to the transfer roller when the second charged images that do not include the toner are transferred onto the recording medium.

14. The image forming apparatus according to claim 13, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

15. The image forming apparatus according to claim 1, wherein a transfer voltage that is applied to the transfer roller when the second charged images that include a toner containing a flat pigment are transferred onto the recording medium is set to be lower than a transfer voltage that is applied to the transfer roller when the second charged images that do not include the toner are transferred onto the recording medium.

16. The image forming apparatus according to claim 15, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

17. The image forming apparatus according to claim 1, wherein the static eliminating roller remove static electricity from the recording medium when a type of the recording medium is a high-resistance type.

18. The image forming apparatus according to claim 17, wherein a transfer voltage that is applied to the transfer roller when the type of the recording medium is the high-resistance type is set to be higher than a transfer voltage that is applied to the transfer roller when the type of the recording medium is not the high-resistance type.

19. The image forming apparatus according to claim 1, further comprising:

a transport belt formed in a ring-like shape and configured to transport the recording medium as a result of an outer circumferential surface of the transport belt coming into contact with a surface of the recording medium that is opposite to the holding surface of the recording medium, wherein the static eliminating roller is disposed in a space enclosed by the transport belt and configured to remove static electricity from the recording medium via the transport belt.

20. The image forming apparatus according to claim 19, wherein the static eliminating roller is a driven roller that is driven and rotated by the transport belt as a result of being in contact with an inner peripheral surface of the transport belt.

* * * * *